US009726001B2

(12) United States Patent
Chugunov et al.

(10) Patent No.: US 9,726,001 B2
(45) Date of Patent: Aug. 8, 2017

(54) METHOD FOR ADAPTIVE OPTIMIZING OF HETEROGENEOUS PROPPANT PLACEMENT UNDER UNCERTAINTY

(71) Applicant: SCHLUMBERGER TECHNOLOGY CORPORATION, Sugar Land, TX (US)

(72) Inventors: Nikita Chugunov, Arlington, MA (US); Joseph P. Morris, Winchester, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 776 days.

(21) Appl. No.: 14/012,724

(22) Filed: Aug. 28, 2013

(65) Prior Publication Data

US 2015/0060053 A1 Mar. 5, 2015

(51) Int. Cl.
*G06G 7/48* (2006.01)
*E21B 43/267* (2006.01)
*E21B 41/00* (2006.01)

(52) U.S. Cl.
CPC ..... *E21B 43/267* (2013.01); *E21B 41/00* (2013.01)

(58) Field of Classification Search
CPC ..... E21B 43/267; E21B 41/00
USPC ..... 703/10
See application file for complete search history.

(56) References Cited

U.S. PATENT DOCUMENTS 6,775,578 B2 8/2004 Couet et al.
6,776,235 B1 8/2004 England
8,066,068 B2 11/2011 Lesko et al.
8,548,785 B2 10/2013 Chugunov et al.
2009/0043555 A1* 2/2009 Busby ..... E21B 43/00 703/10
2013/0110483 A1 5/2013 Chugunov et al.
2014/0207811 A1 7/2014 Kim et al.
(Continued)

FOREIGN PATENT DOCUMENTS

EP 1527255 A1 5/2005
WO 2008068645 A1 6/2008

OTHER PUBLICATIONS

Bandar D. AlAnazi; Mohammed T. Al-Gami; Muffareh Tale; Imad Al-Mushigeh; "Prediction of Poisson's Ratio and Youngs Modulus for Hydrocarbon RFeservoirs Using Alternative Conditional Expectation Algorithm" SPE 138841, 2011, pp. 1-9.*
(Continued)

*Primary Examiner* — Dwin M Craig
(74) *Attorney, Agent, or Firm* — Michael L. Flynn; Jody DeStafanis; Robin Nava

(57) ABSTRACT

Apparatus and methods for delivering and placing proppant to a subterranean formation fracture including identifying control variables and uncertain parameters of the proppant delivery and placement, optimizing a performance metric of the proppant delivery and placement under uncertainty, calculating sensitivity indices and ranking parameters according to a relative contribution in total variance for an optimized control variable, and updating a probability distribution for parameters, repeating optimizing comprising the probability distribution, and evaluating a risk profile of the optimized performance metric using a processor. Some embodiments may deliver proppant to the fracture using updated optimized values of control variables.

14 Claims, 8 Drawing Sheets

(56) References Cited

U.S. PATENT DOCUMENTS

| | | | |
|---|---|---|---|
| 2015/0060058 | A1 | 3/2015 | Morris |
| 2015/0355374 | A1 | 12/2015 | Morton et al. |
| 2016/0216404 | A1 | 7/2016 | Kristensen et al. |

OTHER PUBLICATIONS

Chugunov, et al., "Targeted Survey Design Under Uncertainty", U.S. Appl. No. 14/207,021, filed Mar. 12, 2014, 38 pages.
Gillard, et al., "A New Approach to Generating Fracture Conductivity", SPE 135034—SPE Annual Technical Conference and Exhibition, Florence, Italy, Sep. 20-22, 2010, 14 pages.
Homma, et al., "Importance measures in global sensitivity analysis of nonlinear models", Reliability Engineering & System Safety, vol. 52 (1), Apr. 1996, pp. 1-17.
Medvedev, et al., "On the Mechanisms of Channel Fracturing", SPE 163836—SPE Hydraulic Fracturing Technology Conference, The Woodlands, Texas, Feb. 4-6, 2013, 13 pages.
Morton, et al., "Pressure Transient Test with Sensitivity Analysis", PCT Application No. PCT/US2014/012861, filed Jan. 24, 2014, 55 pages.
Raghuraman, B. et al., "Valuation of Technology and Information for Reservoir Risk Management", SPE 86568—SPE Reservoir Evaluation & Engineering, vol. 6 (5), 2003, pp. 307-315.
Saltelli, Andrea, "Making best use of model evaluations to compute sensitivity indices", Computer Physics Communications, vol. 145 (2), May 15, 2002, pp. 280-297.
Sobol, "Global Sensitivity Indices for Nonlinear Mathematical Models and Their Monte Carlo Estimates", Mathematics and Computers Simulation, vol. 55, 2001, pp. 271-280.
Sobol, "Sensitivity Estimates for Nonlinear Mathematical Models", Math. Modeling & Comp. Exp., vol. 1, 1993, pp. 407-414.
Sobol, I.M., "Quasi-Monte Carlo methods", Progress in Nuclear Energy, vol. 24 (1-3), 1990, pp. 55-61.
Sudret, Bruno, "Global sensitivity analysis using polynomial chaos expansions", Reliability Engineering & System Safety, vol. 93 (7), Jul. 2008, pp. 964-979.
Wiener, Norbert, "The Homogeneous Chaos", American Journal of Mathematics, vol. 60 (4), Oct. 1938, pp. 897-936.
Saltelli, et al., "Global Sensitivity Analysis: The Primer", John Wiley & Sons, Hoboken, 2008, pp. 164-169.
Saltelli, et al., "Sensitivity Analysis in Practice: A Guide to Assessing Scientific Models", John Wiley & Sons, First Edition, Apr. 2, 2004, pp. 42-61 and pp. 109-135.

* cited by examiner

METHOD FOR ADAPTIVE OPTIMIZING OF HETEROGENEOUS PROPPANT PLACEMENT UNDER UNCERTAINTY

FIELD

Embodiments herein relate to hydraulic fracturing including proppant placement.

BACKGROUND

A standard approach to optimization under uncertainty is based on original Markovitz portfolio theory and more recently was tailored to oilfield applications with modified definition of efficient frontier (U.S. Pat. No. 6,775,578 B. Couet, R. Burridge, D. Wilkinson, Optimization of Oil Well Production with Deference to Reservoir and Financial Uncertainty, 2004) and Value of Information (Raghuraman, B., Couët, B., Savundararaj, P., Bailey, W. J. and Wilkinson, D.: "Valuation of Technology and Information for Reservoir Risk Management," paper SPE 86568, SPE Reservoir Engineering, 6, No. 5, October 2003, pp. 307-316). However, these methods employ mean-variance approach and do not provide a much needed insight into the inherent uncertainty of the optimized model and, more importantly, any quantitative guidance on reducing this uncertainty, which is very desirable from the operational point of view.

Application of Global Sensitivity Analysis to address various problems arising in oilfield industry has been described for reservoir performance evaluation, for measurement screening under uncertainty, for pressure transient test design and interpretation, for design and analysis of miscible fluid sampling clean-up, and for targeted survey design. However, these disclosures were focusing only on quantifying uncertainty in specific physical quantities and using that analysis to gain a new insight about the measurement program design and interpretation. The references did not look at optimization of the underlying physical processes.

SUMMARY

Figure 1:
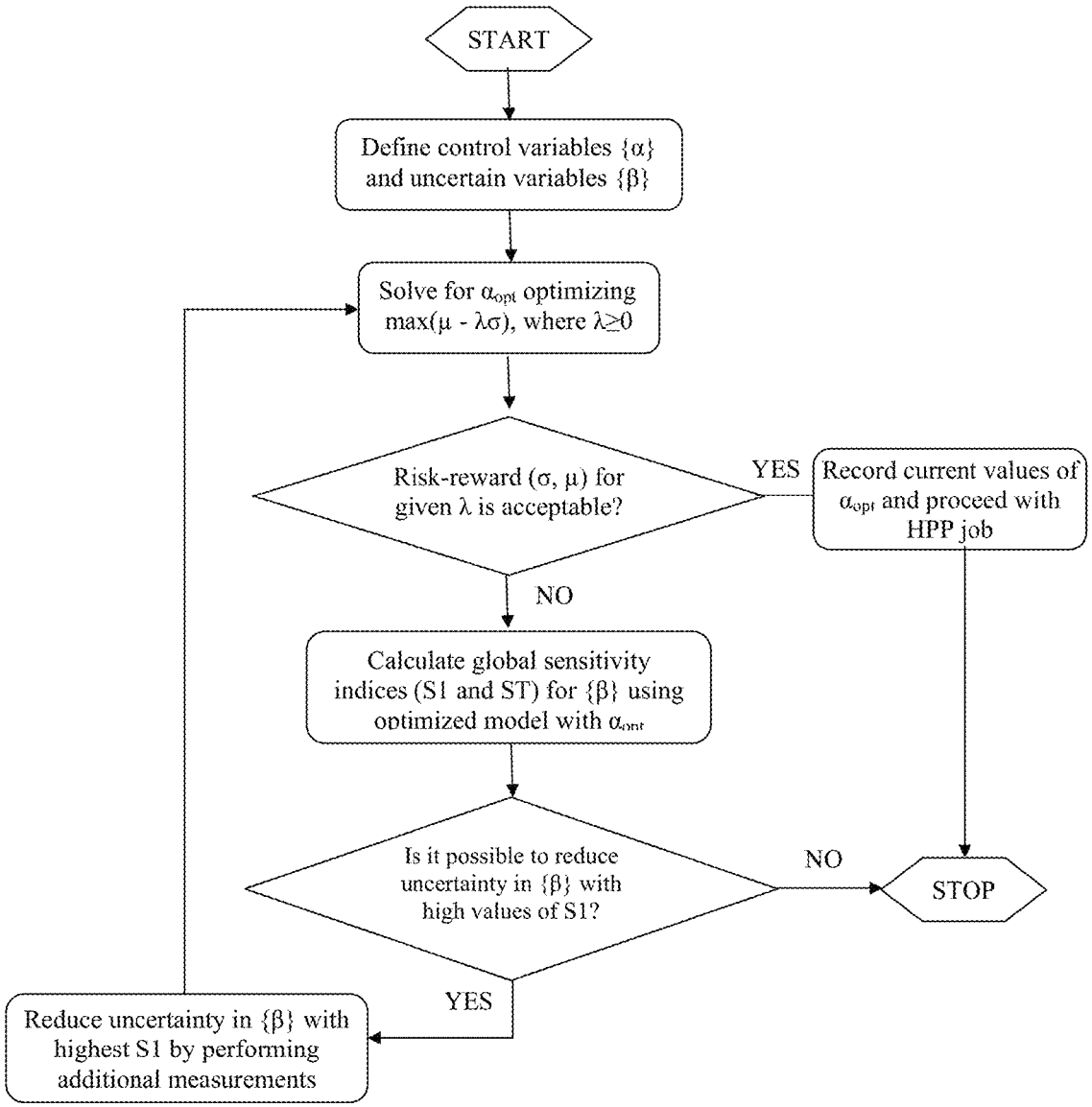
FIG. 1 is a workflow summarizing adaptive GSA-optimization approach.

Embodiments herein relate to apparatus and methods for delivering and placing proppant to a subterranean formation fracture including identifying control variables and uncertain parameters of the proppant delivery and placement, optimizing a performance metric of the proppant delivery and placement under uncertainty, calculating sensitivity indices and ranking parameters according to a relative contribution in total variance for an optimized control variable, and updating a probability distribution for parameters, repeating optimizing comprising the updated probability distribution, and evaluating a risk profile of the optimized performance metric using a processor. Some embodiments may deliver proppant to the fracture using updated optimized values of control variables.

DETAILED DESCRIPTION

This disclosed approach combines Global Sensitivity Analysis (Saltelli et al., 2004) with optimization under uncertainty in an adaptive workflow that results in guided uncertainty reduction of the optimized model predictions. Embodiments herein relate to a general area of optimization under uncertainty. The application of the disclosed method relates to well stimulation and hydraulic fracturing in particular. Heterogenous Proppant Placement (HPP) strategies seek to increase propped fracture conductivity by selectively placing the proppant such that the fracture is held open at discrete locations and the reservoir fluids can be transported through open channels between the proppant. Schlumberger Technology Corporation provides well services that include introducing proppant into the fractures in discrete slugs (Gillard, M. et al., 2010; Medvedev, A. et al., 2013). For the purposes of technology development and optimal implementation, tools must be developed for predicting the conductivity of the heterogeneously propped fractures during the increase in closure stress resulting from flow-back and subsequent production. In the presence of uncertainty in formation properties, optimal HPP strategies will result in inherently uncertain predictions of fracture conductivity. Herein, we describe a method to reduce uncertainty in predicted fracture conductivity and identify an optimal HPP operational strategy for an acceptable level of risk.

Embodiments herein show how a predictive physics-based HPP model is used to estimate fracture conductivity under a given closure stress. The input parameters of the model are divided into control variables (operational controls may include dirty pulse fraction, injector spacing, proppant Young's modulus etc.) and uncertain variables (uncertain formation properties may include Poison ratio, Young's modulus, proppant diffusion rates etc.). The model is first optimized to obtain values of control variables maximizing mean fracture conductivity (for a given closure stress) under initial uncertainty of formation properties. An efficient frontier may be obtained at this step to characterize dependence between the optimized mean value of fracture conductivity and its uncertainty expressed by the standard deviation. Global sensitivity analysis (GSA) is then applied to quantify and rank contributions from uncertain input parameters to the standard deviation of the optimized values of fracture conductivity. Uncertain parameters are ranked according to their calculated sensitivity indices and additional measurements can be performed to reduce uncertainty in the high-ranking parameters. Constrained optimization of the model with reduced ranges of uncertain parameters is performed and a new efficient frontier is obtained. In most cases, the points of the updated efficient frontier will shift to the left indicating a reduction in the risk associated with achieving the desired fracture conductivity. The disclosed method provides an adaptive GSA-optimization approach that results in uncertainty reduction for optimized HPP performance.

The workflow is applied for HPP optimization, which requires a capability for the prediction of the placement of proppant and the resultant conductivity within a potentially rough fracture under any prescribed closure stress. This capability receives inputs relating to the pumping schedule, proppant properties and formation properties and provides a prediction of the achieved fracture conductivity. For example, in our demonstration, we utilize the methods in U.S. Provisional Patent Application Ser. No. 61/870,901, filed Aug. 28, 2013 which is incorporated by reference herein in its entirety where the combination of fracture and proppant is represented by a collection of asperities arranged upon a regular grid attached to two deformable half-spaces. The deformation characteristics of the deformable half-spaces are pre-calculated, allowing for very efficient prediction of the deformation of the formation on either side of the fracture. The method automatically detects additional contact as the fracture closes during increasing closure stress (such as during flow-back and production). In addition, the asperity mechanical response is modified to account for the combined mechanical response of the rough fracture surface and any proppant that may be present in the fracture at that location. In this way, the deformation of any combination of fracture roughness and heterogeneous arrangement of proppant in the fracture can be evaluated. The deformed state is then converted into a pore network model which calculates the conductivity of the fracture during flow-back and subsequent production. Embodiments herein allow one to progressively reduce uncertainty in the performance of an optimized HPP operational strategy by iterative reduction of uncertainty in identified properties of the reservoir.

Optimization Under Uncertainty and Global Sensitivity Analysis

Let us consider a general case when the underlying physical process is modeled by a function $y=f(\alpha, \beta)$, where $\alpha=\{\alpha_1 \ldots \alpha_N\}$ and $\beta=\{\beta_1 \ldots \beta_M\}$ are two sets of parameters. Here, $\alpha$ represents the set of control parameters (to be used in optimization), and $\beta$ denotes the set of uncertain parameters. Mathematically, $\beta$'s are considered to be random variables represented by a joint probability density function (pdf). Therefore, for each vector of control variables $\alpha$, the output of the model is itself a random variable with its own pdf (due to uncertainty in $\beta$). A mean-variance approach is commonly used for optimization, i.e. a function of the form $$F=\mu(\alpha,\beta)-\lambda\sigma(\alpha,\beta)$$

where $\mu$, and $\sigma$ are the mean and standard deviation of the output y of the numerical simulation, and $\lambda$ is a non-negative parameter defining a tolerance to risk (uncertainty). The optimization problem can then be formulated as $$\max_{\alpha} F(\alpha, \beta)$$

For each optimization iteration, a sample of the random vector $\beta$ is chosen, and the values of $y(\alpha, \beta)$ are first computed using this sample for a given a and then averaged over $\beta$.

Various optimization algorithms can then be used to find the optimal value of $\alpha$. The process of optimizing under uncertainty will lead to a set of parameters $\alpha_{opt}$ that provide the optimum of the objective function F. Therefore, an optimized model is now available:

$$y=f(\alpha_{opt},\beta)$$

Note that the optimized model still has inherent uncertainty due to the uncertainty in parameters $\beta$.

Figure 7:
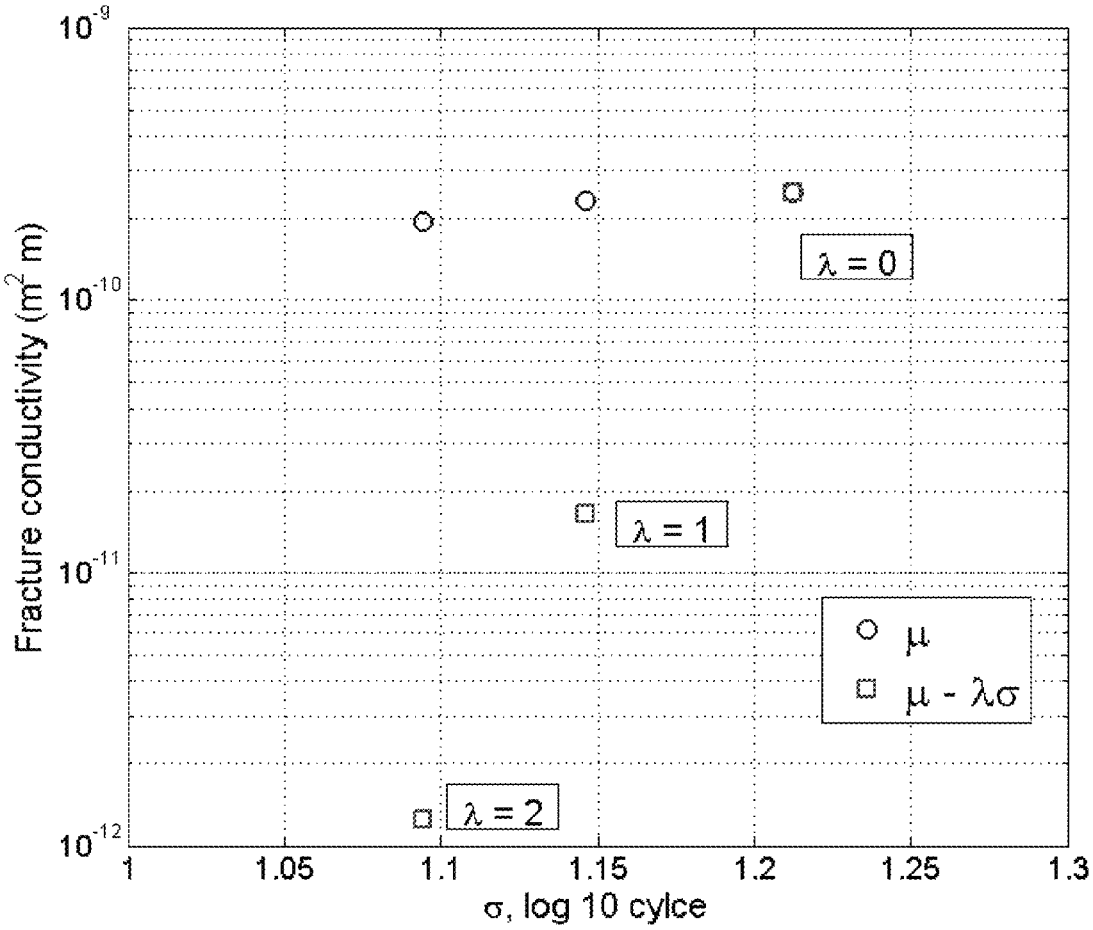
FIG. 7 is a chart plotting three points of the efficient frontier from the optimization using initial ranges for uncertain variables. Lower values of the objective function ($\mu-\lambda\sigma$) for increasing values of $\lambda$ illustrate the inherent penalty for risk.

A set of solutions to the optimization problem can be plotted in $(\mu, \sigma)$ coordinates, where optimal points corresponding to pre-defined values of $\lambda$ will form an efficient frontier (FIG. 7). This represents a risk profile of the underlying modeled process. The positive slope of the frontier illustrates the penalty for additional uncertainty (risk).

From the operational perspective, the goal is to reduce this risk while maintaining the same level of expected performance (represented by $\mu$). In order to reduce the uncertainty, one needs to understand where it is coming from. Therefore, a quantitative link between uncertainties in input parameters ($\beta$) and uncertainty in the output is desirable. This link can be quantified using Global Sensitivity Analysis based on variance decomposition.

Global sensitivity analysis (Saltelli et al., 2004) based on variance decomposition is used to calculate and apportion the contributions to the variance of the measurement signal V(Y) from the uncertain input parameters $\{X_i\}$ of the subsurface model.

For independent $\{X_i\}$, the Sobol' variance decomposition (Sobol', 1993) can be used to represent V(Y) as $$V(Y)=\Sigma_{i=1}^{N}V_i+\Sigma_{1\le i<j\le N}V_{ij}+\ldots+V_{12\ldots N}, \quad (1)$$

where $V_i=V[E(Y|X_i)]$ are the variance in conditional expectations (E) representing first-order contributions to the total variance V(Y) when $X_i$ is fixed i.e., $V(X_i)=0$. Since we do not know the true value of $X_i$ a priori, we have to estimate the expected value of Y when $X_i$ is fixed anywhere within its possible range, while the rest of the input parameters $\{X_{\sim i}\}$ are varied according to their original probability distributions. Thus, $$S1_i=V_i/V(Y)$$

is an estimate of relative reduction in total variance of Y if the variance in $X_i$ is reduced to zero.

Similarly, $V_{ij}=V[E(Y|X_i, X_j)]-V_i-V_j$ is the second-order contribution to the total variance V(Y) due to interaction between $X_i$ and $X_j$. Notice, that the estimate of variance $V[E(Y|X_i, X_j)]$ when both $X_i$ and $X_j$ are fixed simultaneously should be corrected for individual contributions $V_i$ and $V_j$.

For additive models Y(X), the sum of all first-order effects $S1_i$ is equal to 1. This is not applicable for the general case of non-additive models, where second, third and higher-order effects (i.e., interactions between two, three or more input parameters) play an important role. The contribution due to higher-order effects can be estimated via total sensitivity index ST:

$$ST_i=\{V(Y)-V[E(Y|X_{\sim i})]\}/V(Y),$$

where $V(Y)-V[E(Y|X_{\sim i})]$ is the total variance contribution from all terms in Eq. 1 that include $X_i$. Obviously, $ST_i \ge S1_i$, and the difference between the two represents the contribution from the higher-order interaction effects that include $X_i$.

There are several methods available to estimate $S1_i$ and $ST_i$ (see (Saltelli et al., 2008) for a comprehensive review).

In one embodiment, we apply Polynomial Chaos Expansion (PCE) [Wiener, 1938] to approximate the underlying optimized function $y=f(\alpha_{opt},\beta)$. The advantage of applying PCE is that all GSA sensitivity indices can be calculated explicitly once the projection on the orthogonal polynomial basis is computed (Sudret, 2008).

In another embodiment, GSA sensitivity indices can be calculated using an algorithm developed by Saltelli (2002) that further extends a computational approach proposed by Sobol' (1990) and Homma and Saltelli (1996). The computational cost of calculating both $S1_i$ and $ST_i$ is N(k+2), where k is a number of input parameters $\{X_i\}$ and N is a large enough number of model calls (typically between 1000 and 10000) to obtain an accurate estimate of conditional means and variances. However, with underlying physical model taking up to several hours to run, this computational cost can be prohibitively high. Therefore, we can use proxy-models that approximate computationally expensive original simulators. Quasi-random sampling strategies such as LPτ sequences (Sobol, 1990) can be employed to improve the statistical estimates of the computed GSA indices.

Once sensitivity indices are computed, uncertain β-parameters can be ranked according to values of S1. Parameters with the highest values of S1 should be selected for targeted measurement program. Reduction in uncertainty of these parameters will result in largest reduction in uncertainty of predicted model outcome. Parameters with lowest values of ST (typically, below 0.05) can be fixed at their base case value, thus reducing dimensionality of the underlying problem and improving the computational cost of the analysis.

The summary of the proposed general workflow is given in FIG. 1.

The main steps include:

1. Identify control variables (α) and uncertain parameters (β). If applicable, define ranges for control variables. Define probability distribution functions (pdfs) for uncertain parameters.
2. Perform optimization under uncertainty (max F (α, β), where $F=\mu-\lambda\sigma$) and construct relevant points on the efficient frontier for various values of λ.
3. For a given point on the efficient frontier (defined by prescribed value of λ and corresponding values of control parameters $\alpha_\lambda$), calculate GSA sensitivity indices and rank uncertain parameters β according to values of S1.
4. Perform additional measurements to reduce uncertainty of parameters β with high values of S1 and redefine pdfs for those parameters.
5. Optional: fix values of parameters β with low (e.g., below 0.05) values of ST to reduce dimensionality of the optimization problem.
6. Perform steps 2-5 until acceptable level of risk is achieved or until the decision is made that the desired level of performance cannot be achieved with the acceptable level of risk.

Illustrative Example: HPP Optimization Under Uncertainty

We now describe the application to a problem of HPP optimization demonstrating the method.

The underlying physical model along with the methods and numerical tools developed to simulate it are disclosed in "Method for Predicting Heterogeneous Proppant Placement and Conductivity" (U.S. Provisional Patent Application Ser. No. 61/870,901, filed Aug. 28, 2013 which is incorporated by reference above). Below we provide a short description of the main steps involved in calculating fracture conductivity resulting from HPP.

Figure 2:
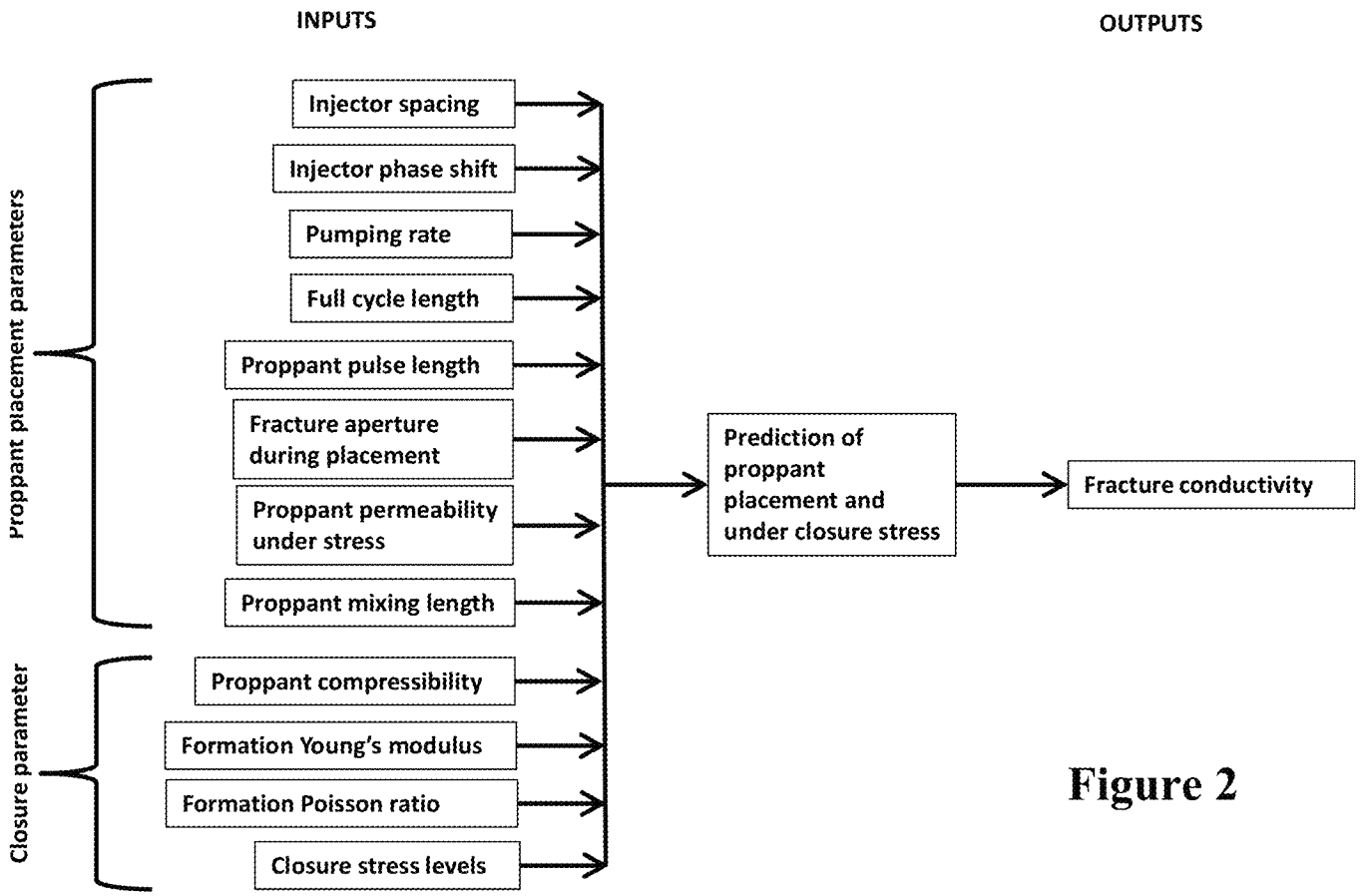
FIG. 2 is a workflow summarizing the inputs and outputs for the example proppant placement and fracture conductivity calculation.
Figure 3:
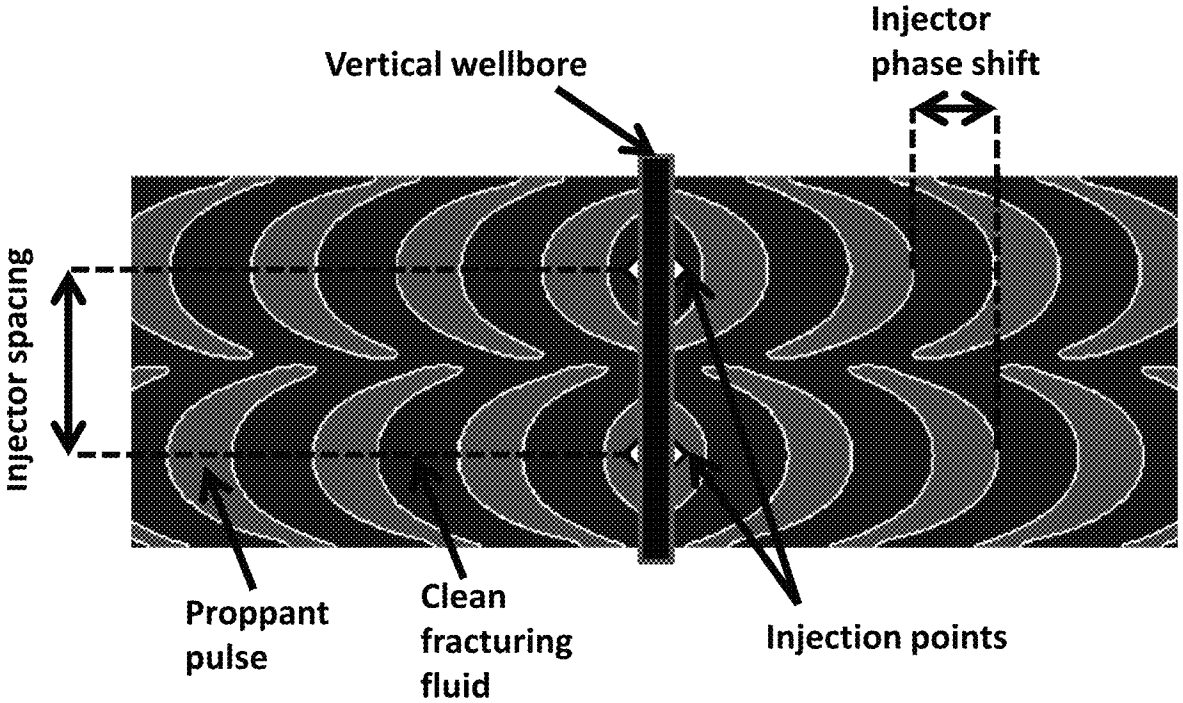
FIG. 3 is a schematic diagram providing a definition of cycle phase shift and perforation spacing for two injectors from a vertical well into a vertical fracture.

FIG. 2 shows a flow diagram highlighting the inputs and outputs utilized in our specific example of fracture conductivity when considering the heterogeneous placement of proppant from a vertical well intersecting a vertical hydraulic fracture as depicted in FIG. 3. In this instance, the heterogeneity of proppant in the fracture is achieved through a combination of pulsing of the proppant into the fracture (see FIG. 4) and mixing phenomena (see FIG. 5) that are characterized by a mixing length.

Figure 6:
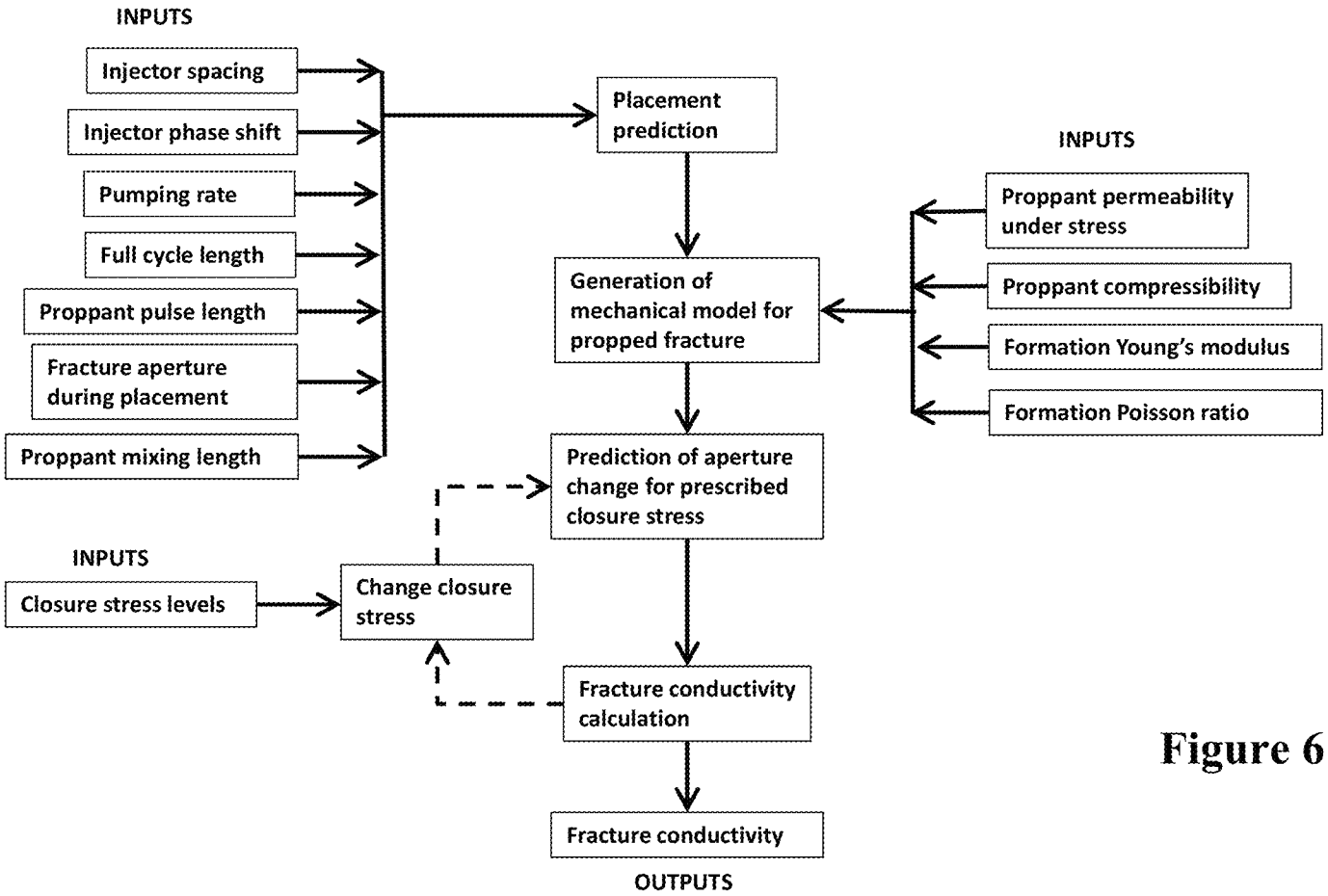
FIG. 6 is a workflow illustrating the inputs, outputs, and workflow for the example proppant placement and fracture conductivity calculation.

FIG. 6 shows in more detail how the inputs are broken down into those related to the placement of the proppant and those related to the subsequent deformation and conductivity calculations. The complete list of model inputs utilized by the example application is provided in Table 1 along with descriptions of the inputs, their units and initial ranges used in this example.

We start by following the steps of the workflow disclosed in FIG. 1.

Step 1. Identify control variables (α) and uncertain parameters (β) and define their ranges and probability distributions.

Control variables (α) include:

1. Injector spacing
2. Pumping rate
3. Full cycle length
4. Proppant pulse length
5. Injector phase shift
6. Proppant Young's modulus
7. Proppant permeability (parameter was fixed in this study since the dominating flow mechanism in successful HPP job should be though the channels formed between the proppant pillars rather than through the proppant itself)

Figure 4:
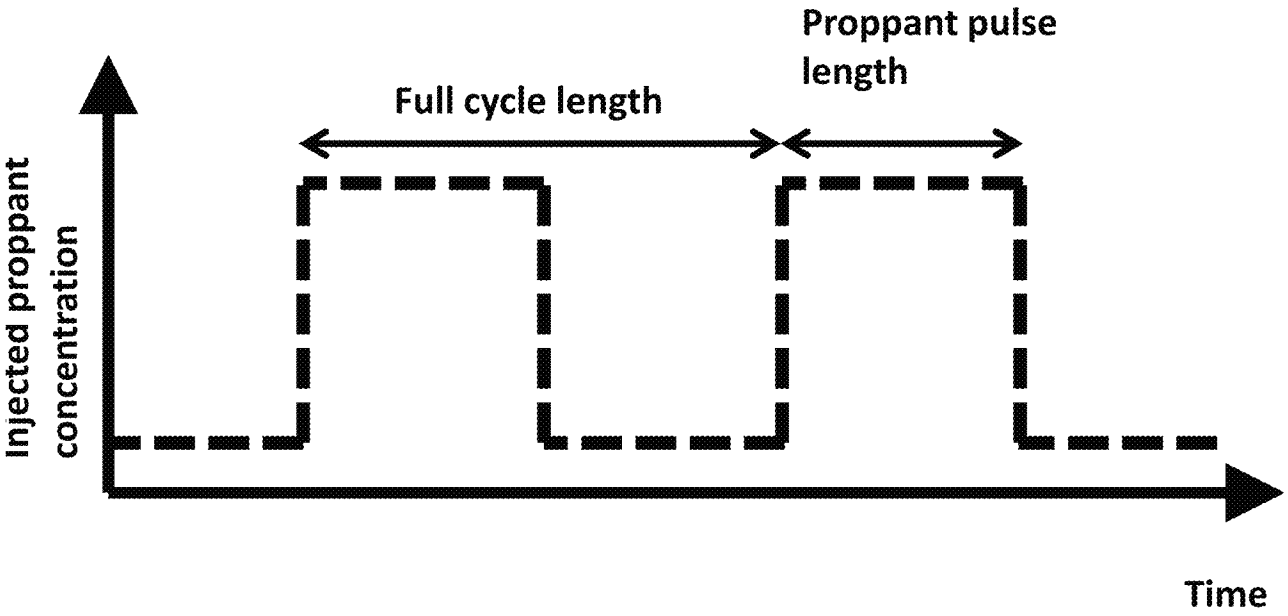
FIG. 4 is a schematic diagram illustrating the length of the cycle and length of the proppant-laden portion.
Figure 5:
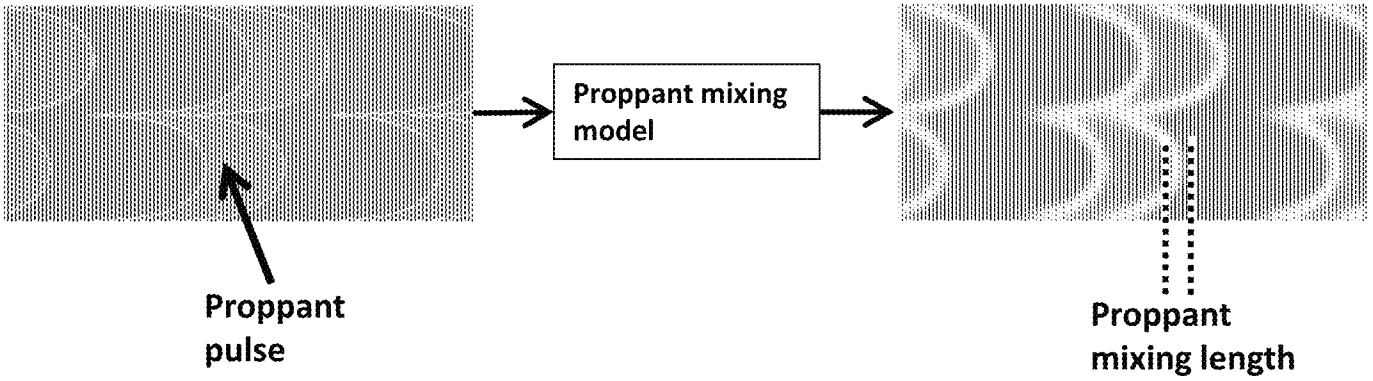
FIG. 5 is a schematic diagram for one example considered. The final placed distribution of proppant is also influenced by mixing between the proppant-laden and clean fracturing fluid portions. The mixing process is characterized by a single mixing length.

Ranges for control variables are given in Table 1. FIG. 4 illustrates some of these variables related to heterogeneous placement of proppant and consequently some systems can accommodate a pumping schedule that includes variations in proppant concentration with time.

Uncertain variables (β) include:

1. Fracture aperture during placement
2. Proppant mixing length
3. Formation Young's modulus
4. Formation Poisson ratio Ranges for uncertain variables are given in Table 1. All variables were assumed to be uniformly distributed, except for "Proppant mixing length" that was assumed to be uniformly distributed on a log scale.

TABLE 1

List of inputs for fracture conductivity calculation applied to injection into a vertically oriented fracture from a vertical well.

| Input | Description | Units | Range |
|---|---|---|---|
| Injector spacing | Vertical distance between injectors | Length (m) | 0.5-3 |
| Pumping rate | | Volume per unit time (bpm) | 0.1-0.5 |
| Full cycle length | Length in time of repeated cycle of heterogeneous injection | Time (s) | 15-25 |
| Proppant pulse length | Fraction of total injection period dedicated to proppant injection | Non-dimensional | 0.25-0.75 |

TABLE 1-continued

List of inputs for fracture conductivity calculation applied to injection into a vertically oriented fracture from a vertical well.

| Input | Description | Units | Range |
|---|---|---|---|
| Injector phase shift | The systematic delay between the cycles of the injectors (as fraction of total cycle length) | Non-dimensional | 0-1 |
| Fracture aperture during placement | Fracture assumed to have constant aperture during displacement for this demonstration. | Length (mm) | 3-7 |
| Proppant permeability under stress | The permeability of the permeability can be stress dependent. In this demonstration it was assumed constant. | Length*Length ($m^2$) | fixed at $10^{-10}$ |
| Proppant mixing length | Characteristic length scale over which proppant and clean fracturing fluid mix during placement | Length (m) | 0.001-0.25 |
| Proppant Young's modulus | Assumed elastic constant characterizing compression of proppant. | Stress (MPa) | 50-500 |
| Formation Young's modulus | | Stress (GPa) | 5-50 |
| Formation Poisson ratio | | Non-dimensional | 0.15-0.35 |
| Closure stress levels | | Stress (MPa) | 0.1-30 |

Step 2. Perform optimization under uncertainty (max F ($\alpha$, $\beta$), where $F=\mu-\lambda\sigma$) and construct relevant points on the efficient frontier for various values of $\lambda$.

The underlying quantity to be optimized is fracture conductivity at a predefined closure stress (20 MPa in this example). In general, the objective function can be based on other performance metrics of proppant delivery and placement in the fracture including total hydrocarbon produced through the fracture, hydrocarbon production rate, and a financial indicator characterizing profitability of the fracturing job. Results of the optimization step comprise a risk profile shown in FIG. 7. Corresponding values of mean, standard deviation for three $\lambda$ points along with P10-P50-P90 estimates for facture conductivity corresponding to these three operational scenarios are given in Table 2.

TABLE 2

Results of optimization with initial uncertainty.

| | $\lambda = 0$ | $\lambda = 1$ | $\lambda = 2$ |
|---|---|---|---|
| Mean fracture conductivity (D · m) | 248.15 | 232.05 | 193.6 |
| Mean fracture conductivity (log 10) | −9.605 | −9.634 | −9.713 |
| Standard deviation (log10 cycles) | 1.21 | 1.15 | 1.10 |
| P90 (D · m) | 2.21 | 2.79 | 2.83 |
| P50 (D · m) | 562 | 507 | 408 |
| P10 (D · m) | 4582 | 3619 | 2622 |

Step 3. For a given point on the efficient frontier (defined by prescribed value of $\lambda$ and corresponding values of control parameters $\alpha_\lambda$), calculate GSA sensitivity indices and rank uncertain parameters $\beta$ according to values of S1.

We apply Polynomial Chaos Expansion approach to calculate GSA sensitivity indices for optimized models corresponding to values $\lambda$=0, 1, 2. The values for first-order sensitivity index (S1) and total sensitivity index (ST) for each uncertain parameter $\beta$ are given in Table 3. For all three optimal points on the efficient frontier, "Proppant mixing length" is responsible for almost 70% of variance in predicted fracture conductivity. The second largest contributor is "Fracture aperture during placement" (15-20% of variance).

TABLE 3

GSA sensitivity indices for optimized models (uncertain parameters ranked according to S1).

| | $\lambda = 0$ | | $\lambda = 1$ | | $\lambda = 2$ | |
|---|---|---|---|---|---|---|
| | S1 | ST | S1 | ST | S1 | ST |
| Proppant mixing length | 0.72 | 0.75 | 0.69 | 0.73 | 0.65 | 0.70 |
| Fracture aperture during placement | 0.17 | 0.18 | 0.17 | 0.18 | 0.19 | 0.20 |
| Formation Young's modulus | 0.08 | 0.11 | 0.09 | 0.13 | 0.11 | 0.15 |
| Formation Poisson ratio | 0.00 | 0.00 | 0.00 | 0.00 | 0.00 | 0.00 |

Step 4. Perform additional measurements to reduce uncertainty of parameters $\beta$ with high values of S1 and redefine pdfs for those parameters.

Based on results of Step 3, "Proppant mixing length" was identified as a single largest contributor to variance of fracture conductivity at 20 MPa. For illustration, we assume that additional measurements were performed to reduce the uncertainty range of this parameter from 0.001 m-0.25 m (slightly more than two log 10 cycles) to 0.005-0.05 (one log 10 cycle) with uniform distribution on log scale.

Step 5. Optional: fix values of parameters $\beta$ with low (<0.05) values of ST to reduce dimensionality of the optimization problem.

Analyzing total-sensitivity values, we notice that "Formation Poisson ratio" has values very close to zero. Therefore, fixing this parameter in the middle of its original uncertainty range (0.15-0.35) will not significantly affect the outcome of the subsequent analysis (Sobol, 2001) while improving its computational cost since the dimensionality of the problem will be reduced.

Step 6. Perform optimization step 2 with updated ranges of uncertain parameters.

Figure 8:
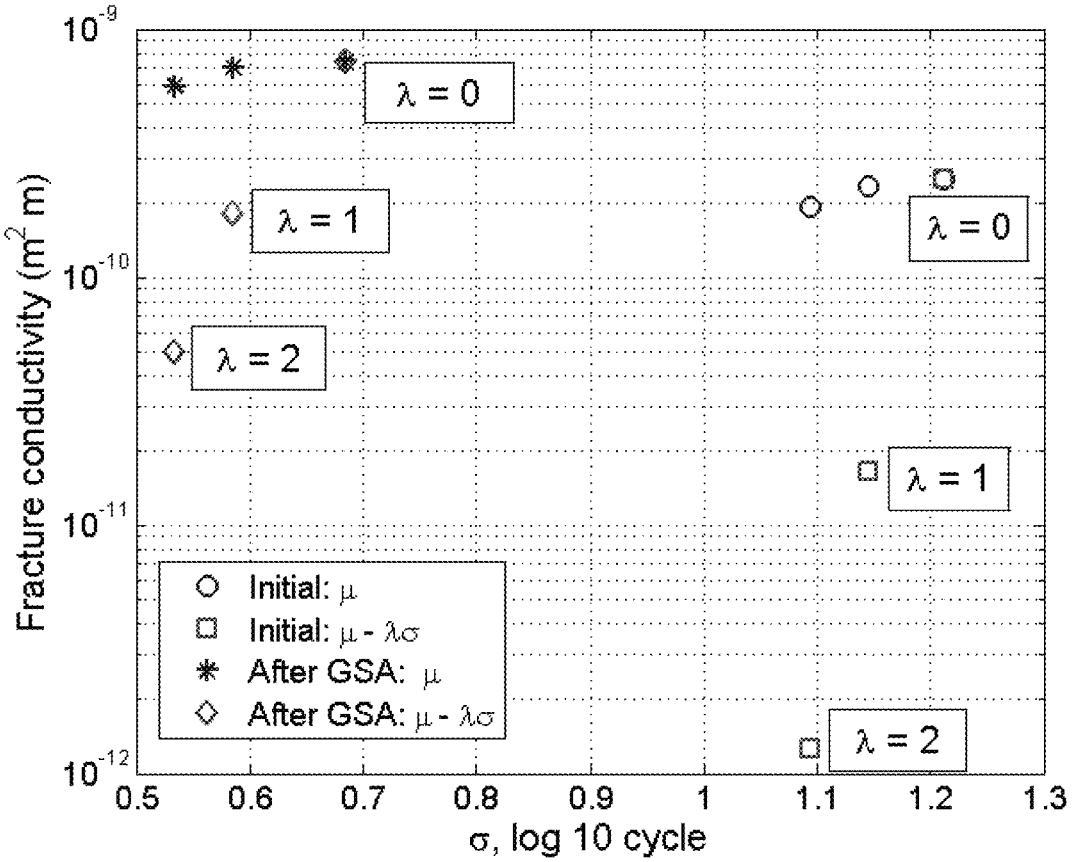
FIG. 8 is a chart plotting three points of the efficient frontier from the optimization using GSA-updated ranges for uncertain variables. Initial efficient frontier points are also included for comparison. Lower values of the objective function ($\mu-\lambda\sigma$) for increasing values of $\lambda$ illustrate the inherent penalty for risk.

Results of the optimization step are shown in FIG. 8. Three points of the initial efficient frontier are also included for comparison. The updated efficient frontier has moved to the left (desired reduction in uncertainty) and slightly up. We note that the vertical direction of the shift in efficient frontier depends on underlying values in the physical quantity of interest (fracture conductivity) in the updated range of the uncertain parameter (Proppant mixing length). Corresponding values of mean, standard deviation for three $\lambda$ points along with updated P10-P50-P90 estimates for facture conductivity corresponding to these three operational scenarios are given in Table 4. We observe the significant reduction in standard deviation (on log scale) compared to the initial case. The reduction in P10-P90 range on a linear scale is also noticeable.

TABLE 4

Results of optimization with updated uncertainty ranges (based on GSA).

| | $\lambda = 0$ | $\lambda = 1$ | $\lambda = 2$ |
|---|---|---|---|
| Mean fracture conductivity (D · m) | 743.39 | 698.31 | 589.72 |
| Mean fracture conductivity (log 10) | −9.129 | −9.156 | −9.229 |
| Standard deviation (log10 cycles) | 0.68 | 0.59 | 0.53 |

TABLE 4-continued

| Results of optimization with updated uncertainty ranges (based on GSA). | | | |
|---|---|---|---|
| | $\lambda = 0$ | $\lambda = 1$ | $\lambda = 2$ |
| P90 (D · m) | 81 | 109 | 103 |
| P50 (D · m) | 981 | 943 | 782 |
| P10 (D · m) | 4494 | 3010 | 2219 |

The shift of efficient frontier to the left is expected in most cases. With the rare exception when the local variance underlying of values in the physical quantity of interest in the updated range of the uncertain parameter is higher than that in the initial range. Although even for this exception case, we argue that the disclosed approach provides iterative way to accurately estimate risk-reward profile for a given HPP job and allows one to avoid costly mistakes that would result in an underperforming fracture.

We disclosed a method for adaptive optimization of heterogeneous proppant placement under uncertainty. A predictive physics-based HPP model is used to estimate fracture conductivity under the desired closure stress. The input parameters of the model are divided into control variables and uncertain variables. The model is first optimized to obtain values of control variables maximizing mean fracture conductivity (at given closure stress) under initial uncertainty of formation properties. An efficient frontier may be obtained at this step to characterize the dependence between the optimized mean value of fracture conductivity and its uncertainty expressed by the standard deviation. Global sensitivity analysis is then applied to quantify and rank contributions from the uncertain input parameters to the standard deviation of the optimized values of fracture conductivity. The uncertain parameters are ranked according to their calculated sensitivity indices and additional measurements can be performed to reduce uncertainty in the high-ranking parameters. Constrained optimization of the model with reduced ranges of uncertain parameters is performed and a new efficiency frontier is obtained. In most cases, the points of the updated efficient frontier will shift to the left indicating reduction in risk associated with achieving the desired fracture conductivity. The disclosed method provides an adaptive GSA-optimization approach that results in iterative improvement of estimated risk-reward profile of an optimized HPP job under uncertainty.

Some embodiments may use a computer system including a computer processor (e.g., a microprocessor, microcontroller, digital signal processor or general purpose computer) for executing any of the methods and processes described herein. The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device. The memory can be used to store computer instructions (e.g., computer program code) that are interpreted and executed by the processor.

The invention claimed is:

1. A method of delivering and placing proppant to a subterranean formation fracture, comprising:

identifying control variables and uncertain parameters of the proppant delivery and placement;

optimizing a performance metric of the proppant delivery and placement under uncertainty;

calculating sensitivity indices and ranking parameters according to a relative contribution in total variance for an optimized control variable; and updating a probability distribution for parameters;

repeating optimizing comprising the probability distribution;

evaluating a risk profile of the optimized performance metric using a processor; and delivering and placing proppant to the subterranean formation fracture using updated optimized values of control variables to control the delivering and placing.

2. The method of claim 1, further comprising identifying initial ranges for control variables and probability distributions for uncertain parameters.

3. The method of claim 1, further comprising constructing multiple points on the efficient frontier.

4. The method of claim 1, wherein the control variables are selected from the group consisting of injector spacing, pumping rate, full cycle length, proppant pulse length, injector phase shift, proppant Young's modulus, proppant permeability, and a combination thereof.

5. The method of claim 1, wherein the uncertain parameters are selected from the group consisting of fracture aperture during placement, proppant mixing length, formation Young's modulus, formation Poisson ratio, and a combination thereof.

6. The method of claim 1, wherein the performance metric of the proppant delivery and placement is selected from the group consisting of fracture conductivity, hydrocarbon production rate, total hydrocarbon produced through the fracture, financial indicator of fracture job profitability, and a combination thereof.

7. The method of claim 1, wherein evaluating the risk profile comprises constructing an efficient frontier.

8. The method of claim 1, further comprising revising a pumping schedule to include variations in proppant concentration with time.

9. The method of claim 1, wherein the calculating sensitivity indices comprises calculating first-order and total sensitivity indices.

10. The method of claim 1, wherein the updating probability distributions comprises performing additional measurements.

11. The method of claim 1, wherein the updating probability distributions comprises fixing a parameter value.

12. The method of claim 11, wherein the parameter value is fixed if a parameter's total sensitivity index is below a threshold value.

13. The method of claim 1, wherein several fractures can be considered.

14. The method of claim 1, wherein delivering and placing proppant to the subterranean formation comprises directing a pump system with a computerized control system utilizing the updated optimized values of control variables.

* * * * *